US006851719B2

(12) United States Patent
Fabel et al.

(10) Patent No.: US 6,851,719 B2
(45) Date of Patent: Feb. 8, 2005

(54) MAILING FORM FOR NON-IMPACT PRINTING

(75) Inventors: Warren M. Fabel, Boca Roton, FL (US); Jose Cortez, Boynton Beach, FL (US)

(73) Assignee: Laser Substrates, Inc., Boca Raton, FL (US)

( * ) Notice: Subject to any disclaimer, the term of this patent is extended or adjusted under 35 U.S.C. 154(b) by 0 days.

(21) Appl. No.: 10/660,026

(22) Filed: Sep. 11, 2003

(65) Prior Publication Data

US 2004/0066032 A1 Apr. 8, 2004

Related U.S. Application Data

(63) Continuation-in-part of application No. 09/864,753, filed on May 24, 2001, now Pat. No. 6,481,754, which is a continuation-in-part of application No. 09/557,492, filed on Apr. 24, 2000, now Pat. No. 6,672,624.

(51) Int. Cl.[7] ..... B42D 15/00
(52) U.S. Cl. ..... 283/116; 283/61; 229/68.1
(58) Field of Search ..... 283/61, 116; 229/68.1, 229/300, 303, 70, 92.8

(56) References Cited

U.S. PATENT DOCUMENTS 4,435,001 A * 3/1984 Mills et al. ..... 229/69
5,425,500 A * 6/1995 Sauerwine ..... 229/303
5,899,504 A * 5/1999 Fabel ..... 283/109
6,126,064 A * 10/2000 Hutchinson ..... 229/92.1

* cited by examiner

*Primary Examiner*—Willmon Fridie
(74) *Attorney, Agent, or Firm*—Jon A. Gibbons; Fleit, Kain, Gibbons, Gutman, Bongini & Bianco P.L.

(57) ABSTRACT

A mailing form for facilitating the mailing of a document is disclosed, the mailing form comprising a first panel, a second panel, and, a third panel of substantially the same area, each panel separated by a horizontal fold line. The mailing form includes a top ply of the mailing form and a document in the second panel. The mailing form further includes a bottom ply coupled to the top ply and a frame portion of the top ply. The mailing form further includes an adhesive on the outer edges of the front of the bottom ply extending over the second and third panel. The mailing form further includes a first horizontal fold line between the first and second panels and a second horizontal fold line between the second and third panels. When the mailing form is in folded form, the document in the second panel is securely situated between the first and third panel.

25 Claims, 10 Drawing Sheets

MAILING FORM FOR NON-IMPACT PRINTING

CROSS-REFERENCED APPLICATIONS

This non-provisional application is a continuation-in-part of the non-provisional patent application Ser. No. 09/864,753, now U.S. Pat. No. 6,481,754 with inventor Fabel entitled "MACHINE SEALABLE MALING FORM FOR NON-IMPACT PRINTING" filed May 24, 2001, which is hereby incorporated by reference in its entirety. The aforementioned non-provisional application is a continuation in part of the non-provisional patent application Ser. No. 09/557,492, now U.S. Pat. No. 6,672,624 with inventor Fabel, entitled "MAILING FORM FOR NON-IMPACT PRINTING" filed Apr. 24, 2000, which is hereby incorporated by reference in its entirety.

PARTIAL WAIVER OF COPYRIGHT

All of the material in this patent application is subject to copyright protection under the copyright laws of the United States and of other countries. As of the first effective filing date of the present application, this material is protected as unpublished material. However, permission to copy this material is hereby granted to the extent that the copyright owner has no objection to the facsimile reproduction by anyone of the patent documentation or patent disclosure, as it appears in the United States Patent and Trademark Office patent file or records, but otherwise reserves all copyright rights whatsoever.

BACKGROUND OF THE INVENTION

1. Field of the Invention

This invention generally relates to the field of mailing forms and more specifically to mailing forms, which can be folded to include a document securely situated inside the mailing form when in folded form.

2. Description of Related Art

As technology progresses, the business office is becoming more and more automated. Faxes, file servers, email, teleconferencing and cell phones have revolutionized the way firms do business. Mailers, in particular, have enjoyed increasing popularity. A mailer is a consumable paper product that allows for quick and easy printing and mailing of information. A mailer can include an envelope, an insert and a return envelope, which may be created by folding the original document. For example, mailers are used to send account statements, invoices, checks, and tax forms to customers and employees of a business. The commonly owned U.S. Patents and U.S. Patent Application described above provide more information on mailers. A mailer allows a firm or business to print directly onto one product all of the information necessary for mailing to a customer, client or employee. This is advantageous as it eliminates the separate printing of an envelope, an insert and a return envelope, as well as the need for the insertion of the return envelope and the insert into the envelope. Mailers, however, do not come without their drawbacks.

One problem with the use of a mailer is producing the mailer. Mailers often require folding and sealing before sending out. Current folding/sealing machines are bulky and costly. Thus, businesses are forced to buy additional equipment, apart from software and printers, in order to produce a mailer. This is cost prohibitive for many businesses. Therefore, a need exists to provide a cost effective method of producing mailers for small and medium businesses.

Another problem with the production of mailers is that current business form printing software requires duplex or multiple pass printers. This is disadvantageous, as the current installed base of printers substantially comprises simplex or single pass printers. It would be advantageous for business form printing software to support the current installed base of single pass printers (simplex), as it is cost effective for those recipients to continue using their current printers, as opposed to purchasing new printers. Therefore, a need exists for a business form printing system that supports simplex or single pass printers.

Non-impact printers, such as laser or ink jet printers, are being increasingly used to provide a fast, economical, and convenient method of printing data on various media, including mailers. Multi-part forms, including envelopes in which documents are sent, together with the documents themselves, have been manufactured for use in impact printers. Such forms are typically assembled into webs with sprocket holes extending along one or both lateral edges to facilitate handling through a pin feed impact printer. Transferable coatings are selectively placed on one or more of the sheets making up the assembly, so that impact-printing forces are transferred to produce characters on intermediate document surfaces. This approach has further been modified to provide a remittance envelope, in which various materials, such as a check and a portion of the statement, may be returned to the organization sending the statement.

However, with the increasing popularity of non-impact printers, especially among small business organizations, the percentage of organizations having the impact printers necessary to use such multi-part forms is decreasing. Therefore, what is needed is a mailer configured for use with non-impact printers. However, by simply adapting the standard available technologies to produce forms that can be used with non-impact printers results in forms that do not have flexibility and the capability for efficient use with non-impact printers. For example, mailers produced by machine-fold and seal technologies available in the 1980s and 1990s were often burdensome or clumsy to open. A perforated strip had to be removed from at least three, and sometimes four, sides of the mail piece. At least two of these strips ran at right angles to the paper grain whereby perforations are least effective for providing a clean tear.

Furthermore, previously available mailers often must be processed through automatic folding/sealing machines to be used in a practical manner. Such automatic folding machines are examples of equipment not available to many small business organizations. Additionally, recipients of the prior-available mailers usually do not read opening instructions printed on the exterior of the mailer. This resulted in frustration on the part of the recipient as well as damage or destruction of the contents of the mailer. This is especially problematic when the contents include a check.

Furthermore, none of these previous embodiments described above allowed for printing of PC postage on a simplex printer. Each PC postage indicia is unique and therefore cannot be pre-printed.

Therefore, a need exists to overcome the problems with the prior art as discussed above.

SUMMARY OF THE INVENTION

Briefly, in accordance with the present invention, disclosed is a mailing form for facilitating the mailing of a document, the mailing form comprising a first panel, a second panel, and a third panel of substantially the same area, each panel separated by a horizontal fold line. In an embodiment of the present invention, the mailing form includes a top ply of the mailing form and a document in the second panel of the top ply, wherein at least a portion of the perimeter of the document is perforated. The mailing form further includes a bottom ply coupled to the top ply, such that the top ply lies on top of the bottom ply and a frame portion of the top ply extending over the second and third panel, wherein an inner diameter of the frame portion is perforated so as to allow the frame portion to be removed.

The mailing form further includes an adhesive on the outer edges of the front of the bottom ply extending over the second and third panel, wherein the adhesive is exposed when the frame portion is removed. The mailing form further includes a first horizontal fold line between the first and second panels such that the back of the first panel is folded so as to meet the back of the second panel and a second horizontal fold line between the second and third panels, such that when the front of the third panel is folded so as to meet the front of the second panel, the outer edges of the front of the second panel and the outer edges of the back of the first panel adhere to the adhesive on the front of the third panel of the bottom ply. When the mailing form is in folded form, the document in the second and third panel of the top ply is securely situated between the first panel and the third panel.

In an embodiment of the present invention, the mailing form further includes a perforation along the inside of the right edge of the bottom ply, the perforation extending through the first, second and third panel, such that the right edge of the bottom ply is removable when the mailing form is in folded form and wherein when the right edge of the bottom ply is removed when the mailing form is in folded form, a right edge of the document is exposed. In another embodiment of the present invention, the mailing form further includes a perforation along the left edge of the document, wherein when the document is pulled in the right direction when the mailing form is in folded form, the perforation breaks and frees the document.

The features of the present invention are advantageous as all printed information is printed on the front face of the mailer 100 and thus it allows the mailer 100 to be printed in a typical sheet-fed non-impact printer. Additionally, it allows the postage indicia and Facing Identification Mark to be printed within ⅛ of an inch of the top edge of an envelope, as required by the U.S. Postal Service (USPS). Additionally, the present invention is advantageous as all printed information is printed on the front face of the mailer and thus it allows the mailer to be printed in a typical sheet-fed non-impact printer. Additionally, it allows all of the text printed on the mailer to be printed in the same orientation. This simplifies the printing process and provides for an efficient allocation of resources.

Another advantage of the present invention is that it results in at least one document being securely situated between layers of paper of the top ply and the bottom ply of the mailer. At least one of the layers that surrounds the document includes, for security purposes, safety or security pantograph, ink shading, or another form of shading that obscures the ability to see through the layers. The documents and are sealed along the edges by adhesives contacting receiving areas of the first panel and the second panel. This produces a robust envelope that securely carries the documents and is able to survive the rigors of mail processing by the. USPS and other entities.

The foregoing and other features and advantages of the present invention will be apparent from the following more particular description of the preferred embodiments of the invention, as illustrated in the accompanying drawings.

BRIEF DESCRIPTION OF THE DRAWINGS

The subject matter, which is regarded as the invention, is particularly pointed out and distinctly claimed in the claims at the conclusion of the specification. The foregoing and other features and also the advantages of the invention will be apparent from the following detailed description taken in conjunction with the accompanying drawings. Additionally, the left-most digit of a reference number identifies the drawing in which the reference number first appears.

DETAILED DESCRIPTION OF THE PREFERRED EMBODIMENTS

The present invention solves the problems with the prior art by providing a mailer that (a) provides a combination outgoing mailer envelope and financial document (e.g., a payment check), (b) protects the integrity of the document within (safety or security pantograph, ink shading or another form of shading obscures the ability to see the document through the surrounding layers), is easily opened and allows for convenient extraction of the contents, (c) can be simplex printed to include all addressing, check information, and MICR encoding and electronic PC postage, including Information-Based Indicia (IBI) and FIM indicia and automatic positioning of same, in a single pass through the simplex printer, and (d) provides these in a form which can be sealed by positive or permanent adhesive sealing means.

Figure 1A:
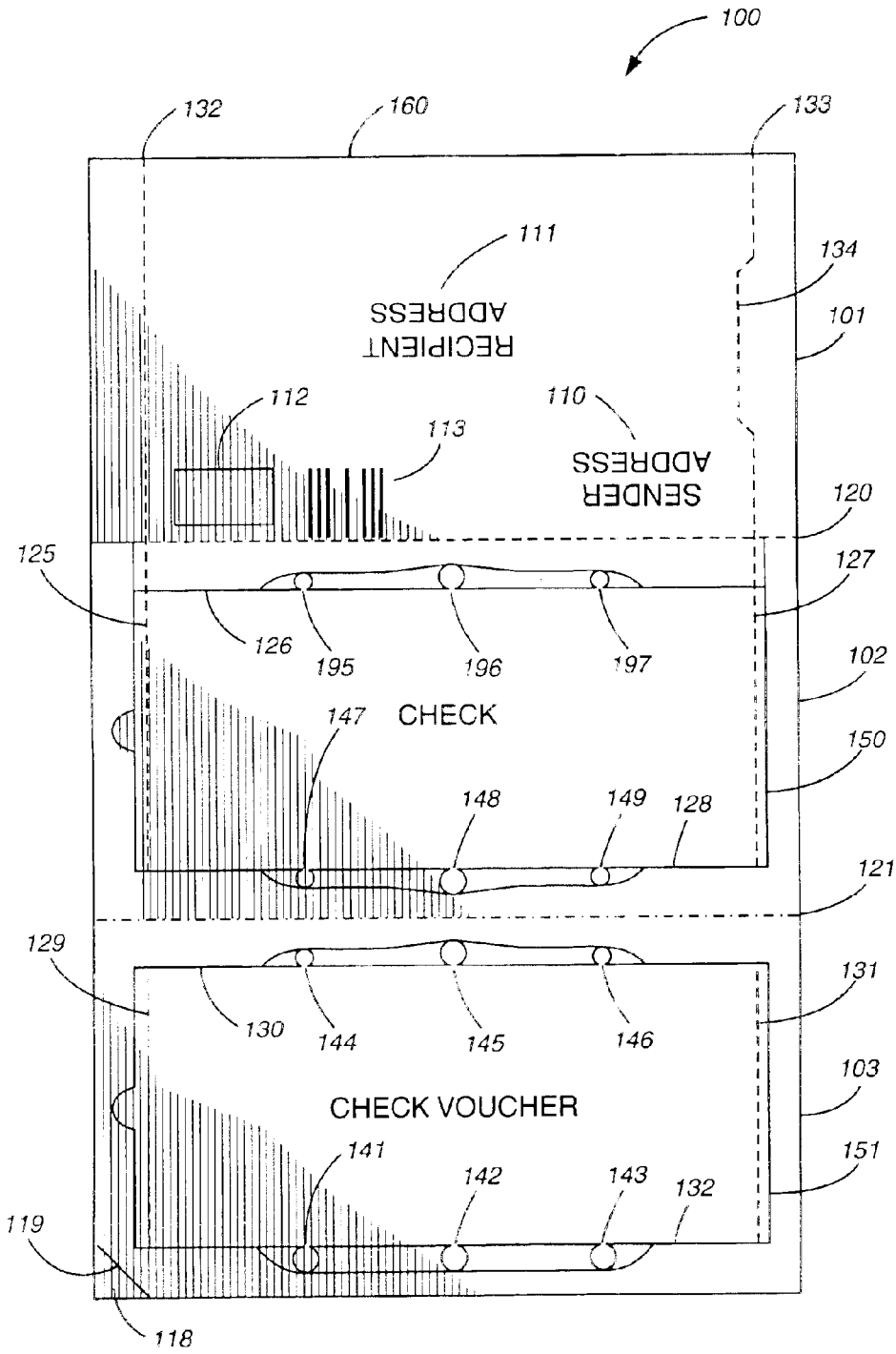
FIG. 1A shows a top view of the front of the mailing form in one embodiment of the present invention.

FIG. 1A shows a top view of the front of the mailing form, or mailer 100, in one embodiment of the present invention. FIG. 1A shows that the mailer 100 comprises a first panel 101, a second panel 102 and a third panel 103 of substantially the same area, each panel separated by a horizontal fold line 120 and 121 as follows (note that horizontal fold line 121 extends through the bottom ply 202 only). Panel 101 is separated from panel 102 by horizontal fold line 120. Panel 102 is separated from panel 103 by horizontal fold line 121.

Figure 2:
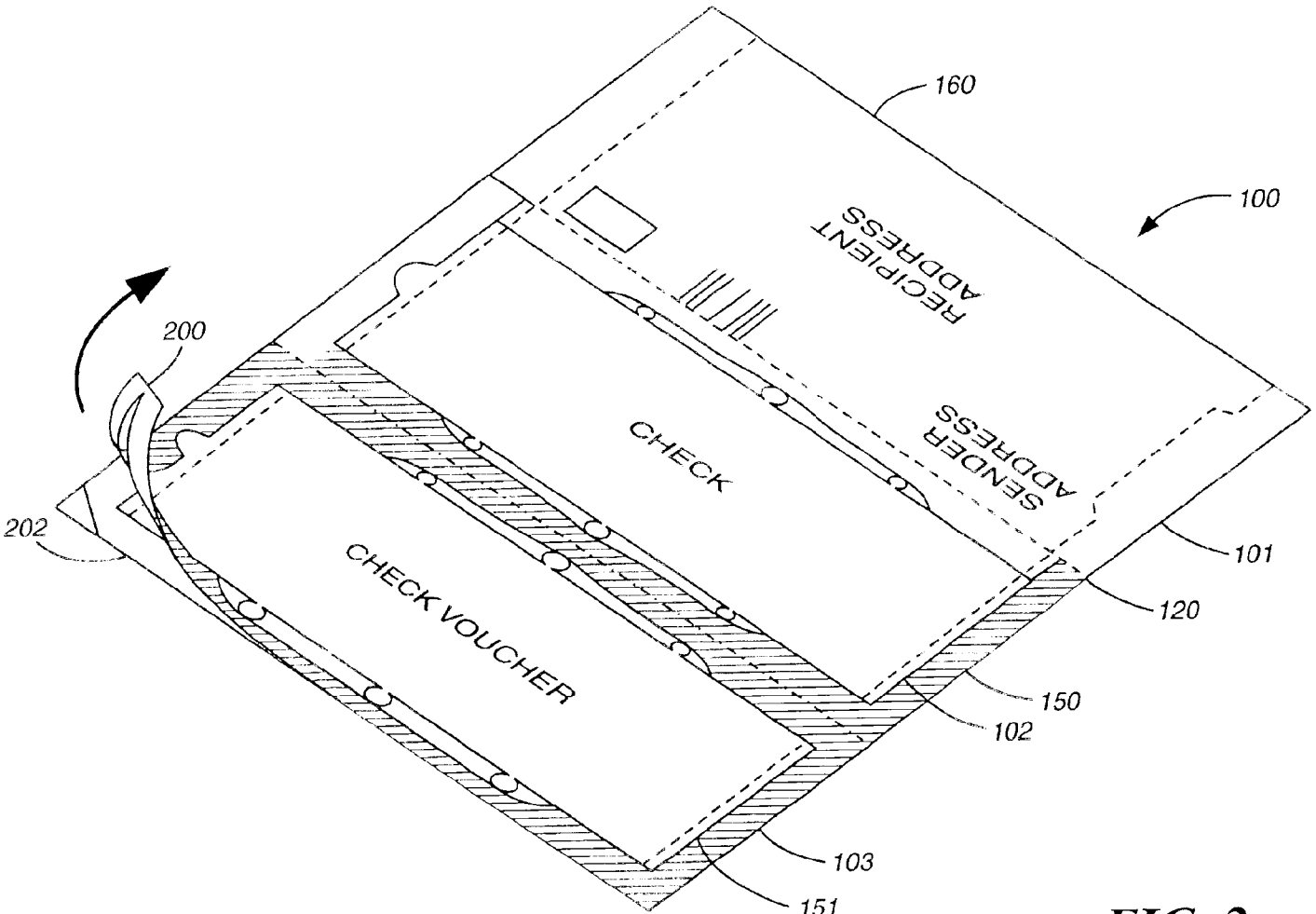
FIG. 2 shows an angled view of the front of the mailing form of FIG. 1A including the frame portion as it is peeled off.

The mailer includes a top ply 160 and a bottom ply 202 (as shown in FIG. 2). As FIG. 1A is a top view of the mailer 100, the top ply 160 consists of the front face of the mailer shown in FIG. 1A. The top ply 160 is a rectangular sheet of paper having dimensions of a standard sheet of paper, e.g., 8.5×11 inches, 8.5×14 inches or A4. It is important to note, that other paper dimensions are possible to those skilled in the art, within the true scope and spirit of the present invention. The bottom ply 202 is not shown in FIG. 1A as it is obstructed by the top ply 160. The top ply 160 and the bottom ply 202 are composed of any number of paper materials and composites that are used as paper substitutes. The top ply 160 can receive printed information when passed through a simplex non-impact printer.

The mailer 100 further includes a document 150 in the second panel 102 of the top ply 160. The document 150 is an invoice, a client account statement, a billing statement, an account report, a check, a tax form (such as a 1099 Div or a 1099 R), an invoice or the like. The mailer 100 further includes a document 151 in the third panel 103 of the top ply 160. The document 151 is any such document as described for document 150. Alternatively, document 151 is a copy of or a stub relating to the document 150, such as a voucher.

The first panel 101 includes a perforation 132 through the top ply 160 along the inside left edge of the first panel 101. The first panel 101 further includes a perforation 133 through the top ply 160 along the inside right edge of the first panel 101. Note that perforation 133 has an indented, or stepped edge 134. The function of the indented edge of the perforation 133 is so that a recipient may have better access for extracting the documents 150 and 151 when the mailer 100 is in folded form. This is described in greater detail below.

The document 150 includes a die cut 126 lining the top edge of the document 150 and a die cut 128 lining the bottom edge of the document 150. The document 150 further includes a perforation 125 lining the left edge of the document 150 and a perforation 127 lining the right edge of the document 150. A die cut is a continuous or substantially continuous cut of a ply or sheet of paper. A perforation is a periodic series of small cuts or holes in a ply or sheet of paper. Various well-known form manufacturing processes can be used to form die cuts and perforations. The document 151 includes a die cut 130 lining the top edge of the document 151 and a die cut 132 lining the bottom edge of the document 151. The document 151 further includes a perforation 129 lining the left edge of the document 151 and a perforation 131 lining the right edge of the document 151. Note that perforations 132, 125, and 129 are collinear. Also note that perforations 133, 127 and 131 are collinear.

The mailer 100 further includes a diagonal die cut 119 in the top ply 160 along the bottom left hand corner of the mailer 100. The diagonal die cut 119 in the top ply 160 begins near the edge of the mailer 100 and ends near the edge of the mailer 100. There is no continuous cut from edge to edge. This allows the triangular portion 118 of the paper of top ply 160 to remain connected to the rest of the top ply 160. This diagonal die cut 119 serves to provide a cut in the top ply 160 so as to allow for the easy separation of the top ply 160 from the bottom ply 202. In order to effect separation of the top ply 160 from the bottom ply 202, the bottom left hand corner edge of the mailer 100 is bent along the diagonal die cut 119. This act results in the separation of edges of the top ply 160 from the bottom ply 202 along the diagonal die cut 119. Subsequently, the edges of the top ply 160 that are separated from the bottom ply 202 can be gripped by a sender and peeled off.

The first panel 101 of the top ply 160 of the mailer 100 includes a set of variable information. The variable information can include, among other things, a sender address, a recipient address, postage indicia and a Facing Identification Mark (FIM—a symbol on envelopes used for facilitating the sorting and routing of mail). Postage indicia include stamp postage, tape postage, PC postage and the like. First panel 101 shows a sender address 110, a recipient address 111, postage indicia 112 and FIM 113. Note that the variable information on the face of the first panel 101 of the top ply 160 is printed in a downward-facing orientation. That is, the text of the variable information is printed upside down, in the top view of the mailer 100 in FIG. 1A. This feature allows the postage indicia 112 and FIM 113 to be printed very close to the horizontal fold line 120. As explained more fully below, mailer 100 is folded along the horizontal fold line 120 such that the backside of the first panel 101 meets the backside of the second panel 102. This results in the fold line 120 being the top edge of the envelope, which is the mailer 100 in its final folded form.

The U.S. Postal Service (USPS) requires that the postage indicia 112 and FIM 113 be printed within ⅛ of an inch of the top edge (in this exemplary embodiment fold 120) of an envelope. The direction of printing of the mailer 100 in a sheet-feed printer is upwards. That is, the mailer 100 enters the printer top-first and printing is performed from top to bottom. Typically, it is difficult, if not impossible, to program a sheet-fed printer to print data precisely near the top edge of paper, as the top edge is the first portion of the paper that is fed into the printer known as the gripper portion. If the postage indicia 112 and FIM 113 were located near the top of the mailer 100, it would be problematic to print the postage indicia 112 and FIM 113 within ⅛ of an inch of the top edge of the mailer 100. Thus, by placing the postage indicia 112 and FIM 113 in a downwards-facing orientation, the postage indicia 112 and FIM 113 are printed near the horizontal fold line 120. Typically, it is possible to program a sheet-fed printer to print data precisely in areas away from the edges of the paper.

The foregoing feature of the present invention is advantageous as all printed information is printed on the front face of the mailer 100 and thus it allows the mailer 100 to be printed in a typical sheet-fed non-impact printer. Additionally, it allows the postage indicia 112 and FIM 113 to be printed within ⅛ of an inch of the top edge of an envelope, as required by the USPS.

To prevent die cut edges, such as the edges produced by die cuts 126 and 128, from catching or otherwise jamming in the printer feeder or paper path, the die-cut can be made incomplete or interrupted by circular (or other geometric shapes) die cuts including ties. The mailer 100 further shows a series of circular die cuts in the top ply 160 adjacent to the document 150 and the document 151. A circular die cut comprises an almost continuous die cut in the top ply 160 in a circular shape. A circular die cut does not constitute a complete circle as the cut stops short of completing the circle. This allows the circle of paper to remain connected to the top ply 160 via a small-uncut portion of the paper of the top ply 160, called a tie. Each of the circular die cuts of FIG. 1A shows a tie, depicted as the location where the circular is not completed.

The backside of each circular die cut of the top ply 160 is coated with a dot of adhesive for holding the documents 150 and 151 to the bottom ply 202. An area of the front face of the bottom ply 202 (shown in FIG. 2) contacts the backside of the die cut and adheres to the adhesive. Thus, the adhesive on the backside of each circular die cut of the top ply 160 contacts and adheres to the front face of the bottom ply 202. Therefore, a die cut of the top ply 160 cannot be pulled off of the bottom ply 202.

Mailer 100 shows a series of three circular die cuts 147, 148 and 149 along the bottom edge of the document 150. Recall that die cut 128 runs along the bottom edge of the document 150. Also, note that the ties of each die cut 147, 148 and 149 are located along the top of each circular die cut such that the die cut 128 is interrupted only by the ties of each circular die cut 147, 148 and 149. This allows the document 150 to remain attached to the top ply 160 while also allowing the document 150 to be removed easily when pulled.

Mailer 100 further shows a series of three circular die cuts 144, 145 and 146 along the top edge of the document 151. Recall that die cut 130 runs along the top edge of the document 151. Also, note that the ties of each die cut 144, 145 and 146 are located along the bottom of each circular die cut such that the die cut 130 is interrupted only by the ties of each circular die cut 144, 145 and 146. This allows the document 151 to remain attached to the top ply 160 while also allowing the document 151 to be removed easily when pulled.

Mailer 100 further shows a series of three circular die cuts 195, 196 and 197 along the top edge of the document 150. Recall that die cut 126 runs along the top edge of the document 150. Also, note that the ties of each die cut 195, 196 and 197 are located along the bottom of each circular die cut such that the die cut 126 is interrupted only by the ties of each circular die cut 195, 196 and 197. This allows the document 150 to remain attached to the top ply 160 while also allowing the document 150 to be removed easily when pulled.

Mailer 100 further shows a series of three circular die cuts 141, 142 and 143 along the bottom edge of the document 151. Recall that die cut 132 runs along the bottom edge of the document 151. Also, note that the ties of each die cut 141, 142 and 143 are located along the top of each circular die cut such that the die cut 132 is interrupted only by the ties of each circular die cut 141, 142 and 143. This allows the document 151 to remain attached to the top ply 160 while also allowing the document 151 to be removed easily when pulled.

Figure 1B:
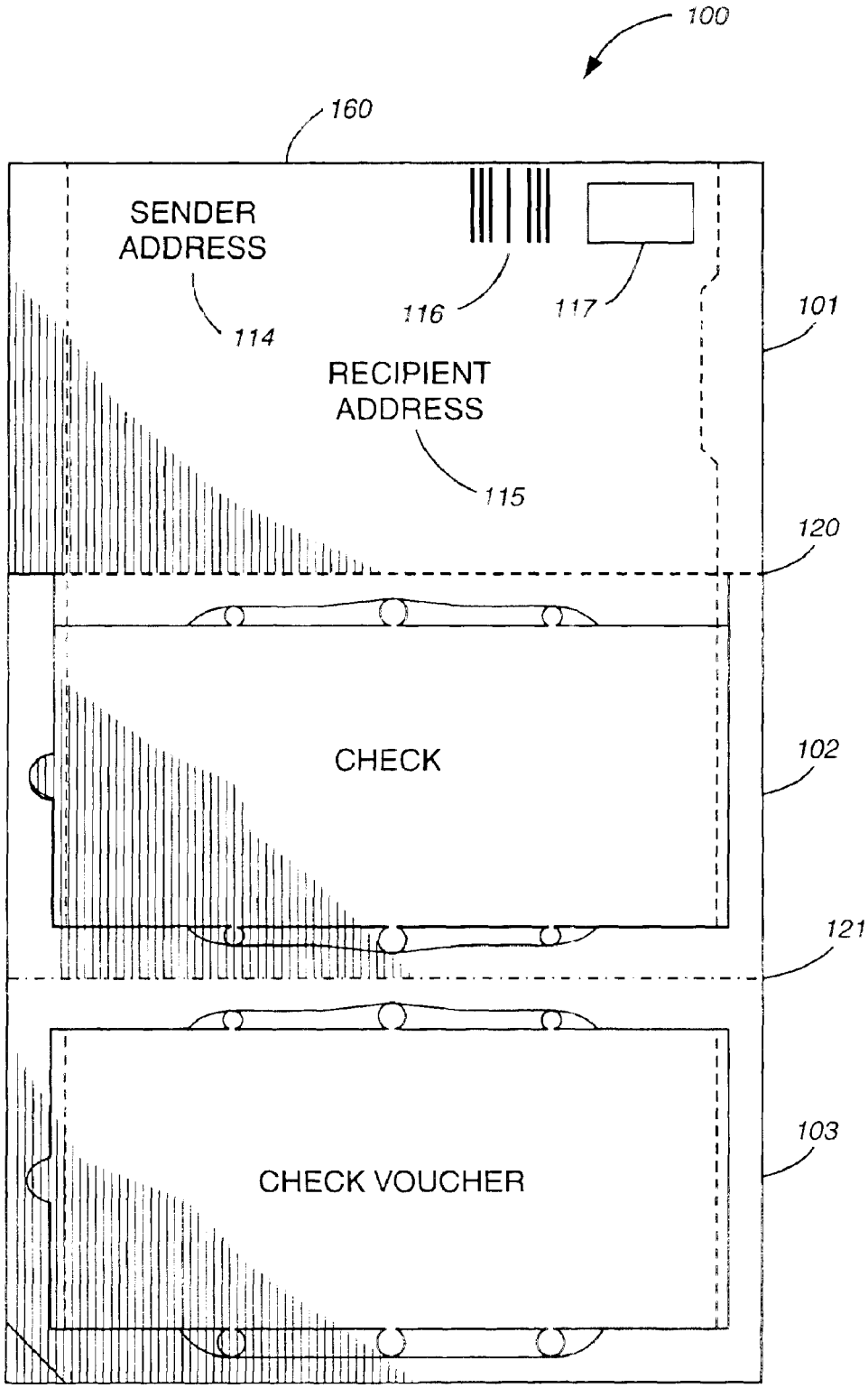
FIG. 1B shows a top view of the front of the mailing form in another embodiment of the present invention.

FIG. 1B shows a top view of the front of the mailing form, or mailer 100, in another embodiment of the present invention. The mailer shown in FIG. 1B is substantially similar to the mailer shown in FIG. 1A. The mailer 100 of FIG. 1B, however, shows the variable information of the first panel 101 is printed in an upwards-facing orientation. First panel 101 shows a sender address 114, a recipient address 115, postage indicia 117 and FIM 116.

The text of the variable information (sender address 114, a recipient address 115, postage indicia 117 and FIM 116) is printed right-side-up, in the top view of the mailer 100 in FIG. 1B. As explained above, mailer 100 is folded along the horizontal fold line 120 such that the backside of the first panel 101 meets the backside of the second panel 102. This results in the fold line 120 being the top edge of the envelope, which is the mailer 100 in its final folded form. The described feature of the present invention does not allow the variable information to be printed very close to the horizontal fold line 120. The foregoing feature, however, is advantageous as all printed information is printed on the front face of the mailer 100 and thus it allows the mailer 100 to be printed in a typical sheet-fed non-impact printer. Additionally, it allows all of the text printed on the mailer 100 to be printed in the same orientation. This simplifies the printing process and provides for an efficient allocation of resources.

FIG. 2 shows an angled view of the front of the mailing form, or mailer 100, of FIG. 1A including the frame portion 200 (shaded for emphasis) as it is peeled off. FIG. 2 shows that in addition to the top ply 160, the mailer 100 further includes a bottom ply 202 coupled to the top ply, such that the top ply 160 lies on top of the bottom ply 202. In an embodiment of the present invention, the top ply 160 extends over the first panel 101, the second panel 102 and the third panel 103. The bottom ply 202 also extends over the first panel 101, second panel 102 and the third panel 103. The bottom ply 202 is connected to the top ply 202 along the fold line 120, making a "Y" shaped construction of mailer 100 when viewed from a side along perforation 125 showing the peeling of 200 along die cut 132 (not shown) illustrating the bottom ply 202 and the top ply 202 being separated. Stated differently, when viewing the mailer 100 from a side along perforation 125, the first panel 101 defines the lower stem of the "Y" formed by top ply 160 and bottom ply 202. Next, the right and left wings of the "Y" are defined by the bottom ply 202 and the top ply 160 as follows. The right wing of the "Y" is defined by the second panel 102 along with third panel 103 of the bottom ply 202. The left wing of the "Y" and the second panel 102 along with third panel 103 of the top ply 160. Accordingly, a "Y" shaped construction of mailer 100 is realized.

FIG. 2 shows the frame portion 200, wherein the frame portion 200 is shaded to indicate its location. The frame portion 200 is a part of the top ply 160 of the mailer 100. Frame portion 200 extends around document 151 so as to frame the document 151. Frame portion 200 also extends around the sides and the bottom of the document 150 so as to partially frame the document 150. FIG. 2 shows that the frame portion 200 is separated from the remaining portions of the top ply 160 via die cuts. This feature allows for the easy removal of the frame portion 200 from the mailer 100.

In an embodiment of the present invention, the frame portion 200 of the top ply 160 also includes a portion of the bottom ply 202—referred to as an L-frame. The L-frame is a portion of the bottom ply 202 that extends around both sides of the document 150 (in second panel 102) and along the bottom side of the document 150 (in second panel 102), but not including section 304 (see FIG. 3) of the bottom ply 202 in second panel 102. Thus, the area of bottom ply 202 that is integral with the frame portion 200 in this embodiment is two L-shaped portions of bottom ply 200—hence the term "L-frame."

The backside of the frame portion 200 of the top ply 160 is coated with a releasable substrate such as silicon. Further, the area of the front face of the bottom ply 202 that contacts the backside of the frame portion 200 is coated with an adhesive. Thus, the releasable substrate on the backside of the frame portion 200 of the top ply 160 contacts and releasably adheres to the adhesive on the front face of the bottom ply 202. As the frame portion 200 of the top ply 160 is pulled off of the bottom ply 202, the releasable substrate on the backside of the frame portion 200 releases from the adhesive on the front face of the bottom ply 202. This allows the frame portion 200 to be removed easily when pulled such that the releasable substrate on the backside of the frame portion 200 releases from the adhesive on the front face of the bottom ply 202.

Figure 3:
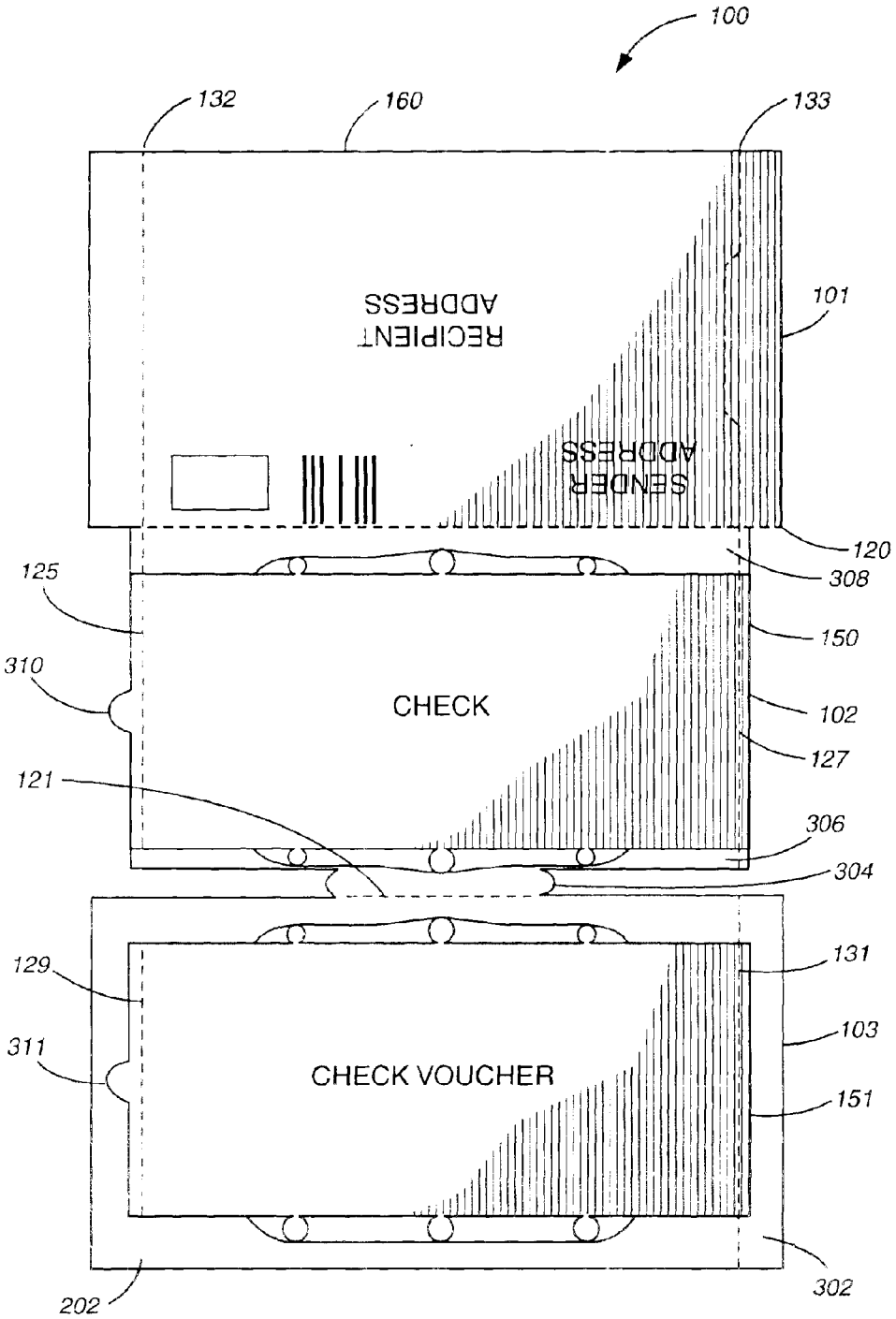
FIG. 3 shows a top view of the front of the mailing form of FIG. 1A without the frame portion.

FIG. 3 shows a top view of the front of the mailing form, or mailer 100, of FIG. 1A without the frame portion 200.

FIG. 3 shows the mailer 100 after the frame portion 200 of the top ply 160 has been removed, as shown in FIG. 2. After the removal of the frame portion 200, an area 302 of the bottom ply 202 is exposed. This area 302 frames the area around the document 151. The area of the front face of the bottom ply 202 (i.e., area 302) that contacts the backside of the frame portion 200 is coated with an adhesive. Thus, the releasable substrate on the backside of the frame portion 200 of the top ply 160 contacts and releasably adheres to the adhesive on the area 302 of the bottom ply 202. After the removal of the frame portion 200, the adhesive on the front face of area 302 of the bottom ply 202 is exposed.

FIG. 3 also shows a connector 304, which is a strip of paper of the bottom ply 202 that connects the first panel 102 with the second panel 103. Horizontal fold line 121 runs along the bottom part of the connector 304. Also shown is area 308, which is a horizontal strip of paper above the top of the document 150 and below the fold line 120. Further shown is area 306, which is a horizontal strip of paper below the bottom of the document 150 and above the fold line 121. In FIG. 3, the document 151, the document 150 and area 308 are part of the top ply 160. Additionally, the top panel 101 is comprised solely of the top ply 160. The area 302, area 306 and the connector 304 are part of the bottom ply 202.

FIG. 3 further shows a perforation 133, which runs along the inner edge of the right side of the first panel 101 of the mailer 100. In the first panel 101, the perforation 133 perforates only the top ply 160, as the first panel 101 comprises only the top ply 160. In the second panel 102, the perforation 127, which is collinear with the perforation 133, perforates both the top ply 160 and the bottom ply 202 in the area 308 and the document 150. The perforation 127 further extends through the area 306 of the second panel 102, though here the perforation perforates only through the bottom ply 202. In the third panel 103, the perforation 131 perforates both the top ply 160 and the bottom ply 202 in the document 151. In the area 302, the perforation 131 perforates the bottom ply 202.

FIG. 3 further shows a perforation 132, which runs along the inner edge of the left side of the first panel 101 of the mailer 100. In the first panel 101, the perforation 132 perforates only the top ply 160, as the first panel 101 comprises only the top ply 160. In the second panel 102, the perforation 125, which is collinear with the perforation 132, perforates both the top ply 160 and the bottom ply 202 in the area 308 and the document 150. The perforation 125 further extends through the area 306 of the second panel 102, though here the perforation perforates only through the bottom ply 202. In the third panel 103, the perforation 129 perforates both the top ply 160 and the bottom ply 202 in the document 151. In the area 302, the perforation 129 perforates the bottom ply 202.

FIG. 3 further shows a semicircular tab 310 and a semicircular tab 311 that are part of the top ply 160. The tab 310 is connected to the left side of the document 150, though the tab 310 and the document 150 are divided by the perforation 125. The function of tab 310 is so that a recipient may easily extract the documents 150 and 151 when the mailer 100 is in its folded form (see FIGS. 6–11). The recipient may extract the documents 150 and 151 by holding the tab 310 between thumb and forefinger, pulling the documents 150 and 151 towards the right and enabling the tab 310 to separate from the document 150 along the perforation 125 so as to release the document 150.

The tab 311 is connected to the left side of the document 151, though the tab 311 and the document 151 are divided by the perforation 129. The function of tab 311 is so that a recipient may easily extract the documents 150 and 151 when the mailer 100 is in its folded form (see FIGS. 6–11). The recipient may extract the documents 150 and 151 by holding the tab 311 between thumb and forefinger, pulling the document 151 towards the right and enabling the tab 311 to separate from the document 151 along the perforation 129 so as to release the document 151.

Figure 4:
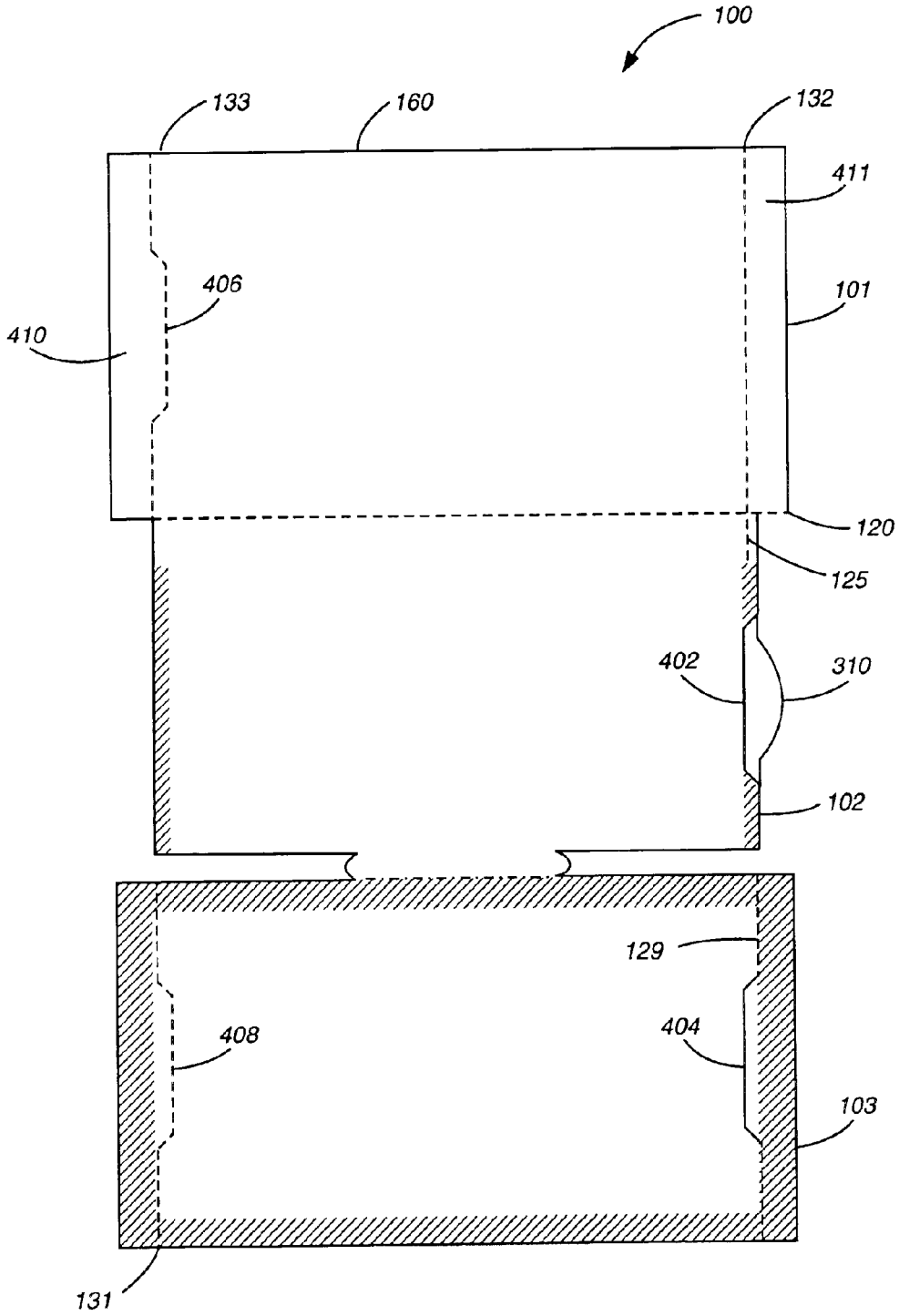
FIG. 4 shows a top view of the back of the mailing form of FIG. 1A without the frame portion.

FIG. 4 shows a top view of the back of the mailing form, or mailer 100, of FIG. 1A without the frame portion 200. The second panel 102 and the third panel 103 show only the bottom ply 202 in this FIG. 4. The tab 310, however, which is a part of the top ply 160, juts out from behind the bottom ply 202. The top ply 160 is coupled to the bottom ply 202 along the fold line 120.

FIG. 4 also shows indented edge 402 on the side of the second panel 102 of the bottom ply 202. The function of indented edge 402 is so that a recipient may have better access for holding the tabs 310 and 311 during extraction of the documents 150 and 151 (not shown in this view) when the mailer 100 is in folded form (see FIGS. 6–11). In extracting the documents 150 and 151, the recipient holds the tabs 310 and 311 between thumb and forefinger, allowing the recipient to pull the documents 150 and 151 and enabling the tabs 310 and 311 to separate from the documents 150 and 151 along the perforations 125 and 129, respectively, so as to release the documents 150 and 151.

FIG. 4 further shows indented edge 404 (part of perforation 129) on the side of the third panel 103 of the bottom ply 202. The function of indented edge 404 is so that a recipient may have better access for holding the tabs 310 and 311 during extraction of the documents 150 and 151 when the mailer 100 is in folded form. In extracting the documents 150 and 151, the recipient holds the tabs 310 and 311 (which are underneath the bottom ply 202 of the third panel 103) between thumb and forefinger, allowing the recipient to pull the documents 150 and 151 and enabling the tabs 310 and 311 to separate from the documents 150 and 151 along the perforations 125 and 129, respectively, so as to release the documents 150 and 151. FIG. 4 further shows indented edge 406 (part of perforation 133) on the side of the first panel 101 of the bottom ply 202 and indented edge 408 (part of perforation 131) on the side of the third panel 103 of the bottom ply 202. The function of indented edge 406 and 408 is similar to the function described for indented edges 402 and 404.

FIG. 4 further shows area 410, which is a strip of paper along the edge of the side of the first panel 101 of the top ply 160. The area 410 is divided from the remaining portions of the top ply 160 by a perforation 133. FIG. 4 also shows area 411, which is also a strip of paper along the edge of the side of the first panel 101 of the bottom ply 202. The area 411 is divided from the remaining portions of the top ply 160 by a perforation 132.

Figure 5:
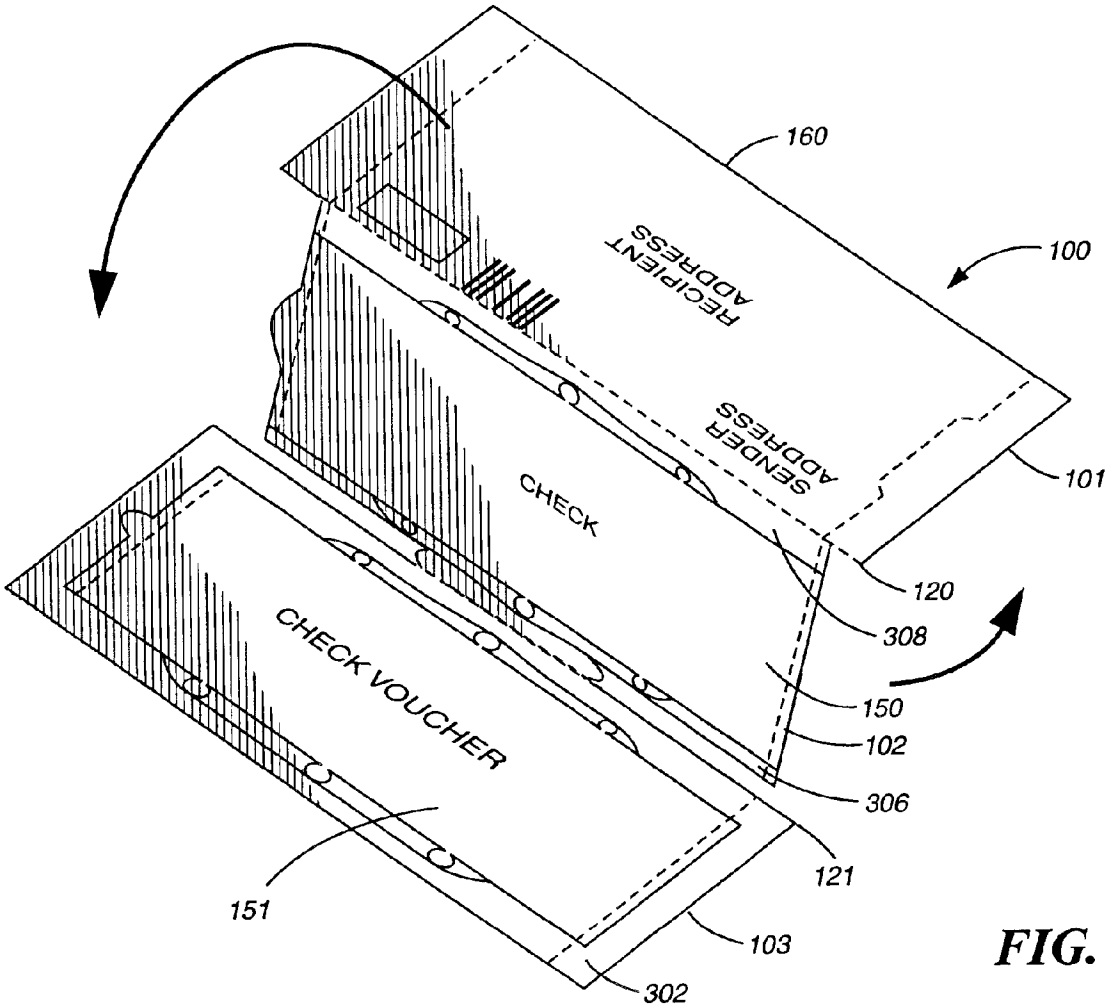
FIG. 5 shows an angled view of the front of the mailing form of FIG. 1A showing the mailing form being folded for mailing.

FIG. 5 shows an angled view of the front of the mailing form, or mailer 100, of FIG. 1A showing the mailer 100 being folded for mailing. FIG. 5 shows that the front face of the third panel 103 of the top ply 160 is folded along horizontal fold line 121 so as to meet the front face of the second panel 102 of the top ply 160. Also the back face of the first panel 101 of the top ply 160 is folded along horizontal fold line 120 so as to meet the back face of the second panel 102 of the bottom ply 202.

Upon folding of the third panel 103, note that the entire area 302 is lined with an adhesive. Thus, when the front face of the third panel 103 is folded along horizontal fold line 121 so as to meet the front face of the second panel 102, the adhesive on area 302 contacts and adheres to corresponding areas in the second panel 102. Namely, the adhesive along the top and bottom of area 302 adheres to areas 304, 306 and 308 of the second panel 102. Also, when the back face of the first panel 101 is folded along horizontal fold line 120 so as to meet the back face of the second panel 102, the adhesive on area 302 contacts and adheres to corresponding areas in the first panel 101. Namely, the adhesive along the right and left sides of area 302 adheres to area 410 and area 411 of the first panel 101 (see FIG. 4).

The foregoing feature of the present invention is advantageous as it results in the document 150 and the document 151 being securely situated between layers of paper of the top ply 160 and the bottom ply 202. Further, the documents 150 and 151 are sealed along the edges by the adhesive of the area 302 contacting receiving areas of the first panel 101 and the second panel 102. This produces a robust envelope that securely carries the documents 150 and 151 and is able to survive the rigors of mail processing by the USPS and other entities.

Figure 6:
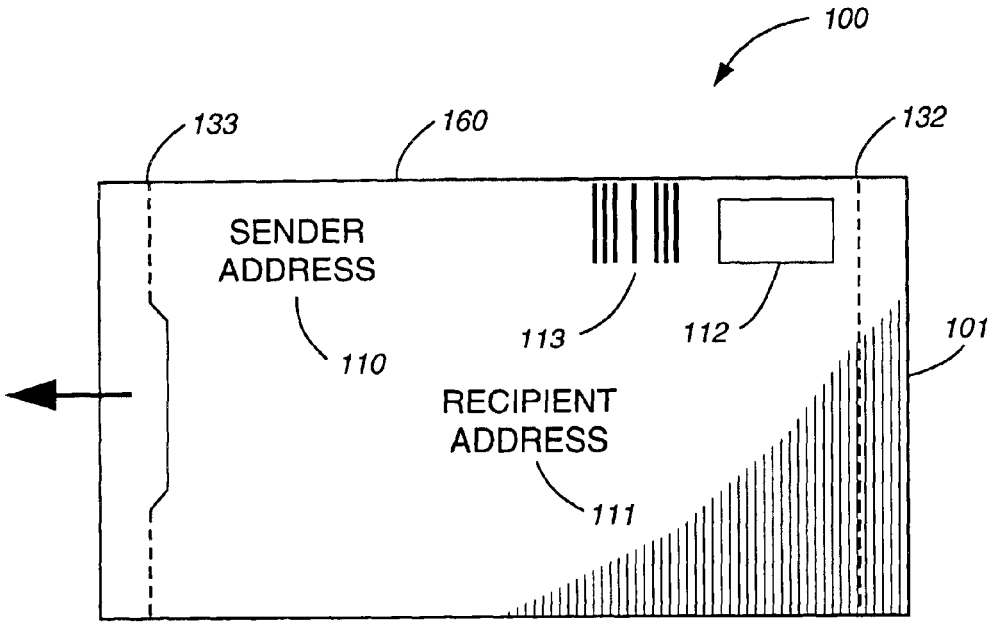
FIG. 6 shows a top view of the front of the mailing form of FIG. 1A in folded form, ready for mailing.

FIG. 6 shows a top view of the front of the mailing form, or mailer 100, of FIG. 1A in folded form, ready for mailing. FIG. 6 shows the front face of the first panel 101 of top ply 160. The first panel 160 shows variable information including, among other things, a sender address, a recipient address, postage indicia and a FIM. First panel 101 shows a sender address 110, a recipient address 111, postage indicia 112 and FIM 113. FIG. 6 also shows the perforations 133 and 132.

In order to open the envelope formed by the mailer 100 in folded form, the right side of the envelope (to the right of perforation 132) must be held by a recipient utilizing his thumb and forefinger. By holding the right side of the envelope to the right of perforation 132, the recipient is holding the side of the first panel 101 of the top ply 160, the tab 310 and the tab 311. Next, the left side of the envelope (to the left of perforation 133) must be held by a recipient utilizing his other thumb and forefinger. By holding the left side of the envelope to the left of perforation 133, the recipient is holding the side of the first panel 101 of the top ply 160, the document 150 and the document 151. Then, as shown by the arrow 602, the recipient pulls to the left so as to break the perforation 133, as well as perforations 127 and 131. The documents 150 and 151 are then exposed and can be extracted. This is described in greater detail below.

Figure 7:
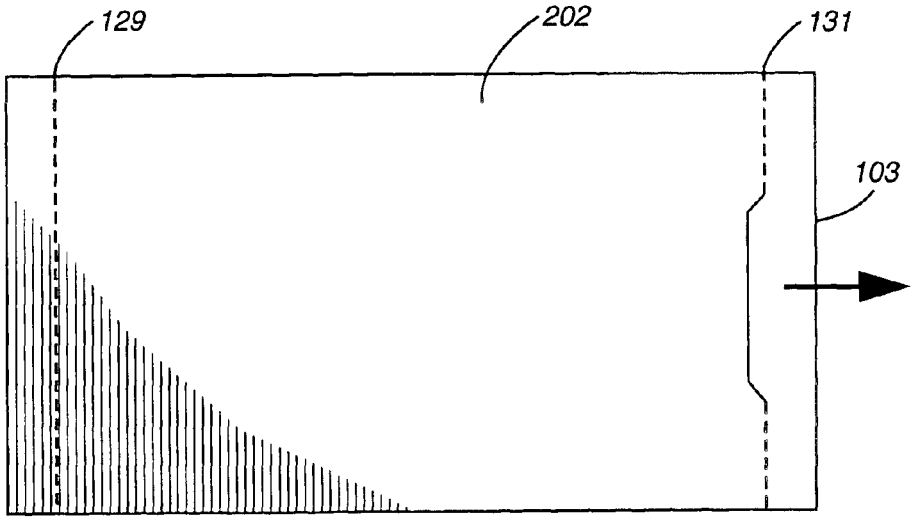
FIG. 7 shows a top view of the back of the mailing form of FIG. 1A in folded form, ready for mailing.

FIG. 7 shows a top view of the back of the mailing form, or mailer 100, of FIG. 1A in folded form, ready for mailing. FIG. 7 shows the back face of the third panel 103 of the bottom ply 202. FIG. 7 also shows the perforations 129 and 131.

Figure 8:
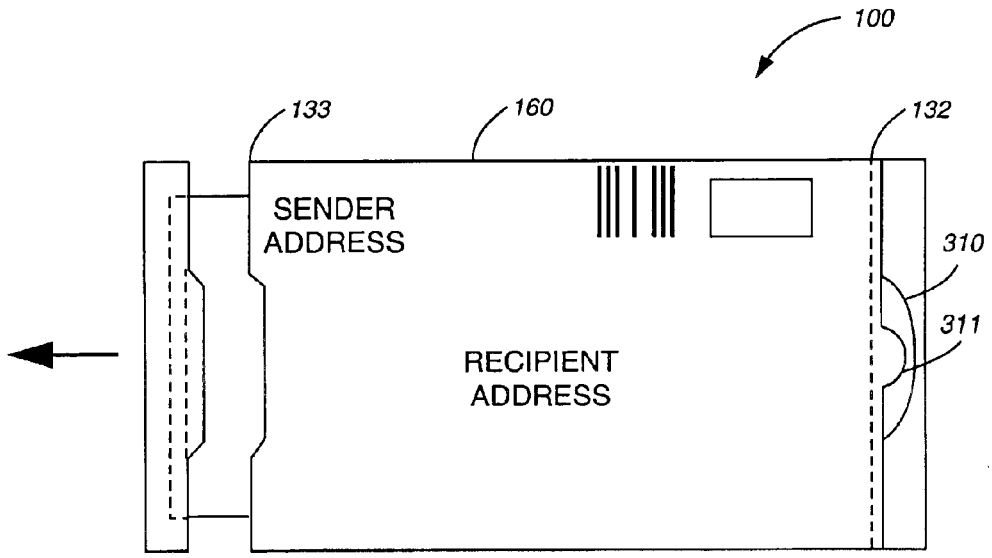
FIG. 8 shows a top view of the front of the mailing form of FIG. 1A as it is being opened by the recipient.

FIG. 8 shows a top view of the front of the mailing form, or mailer 100, of FIG. 1A as it is being opened by the recipient. FIG. 8 shows that the recipient first holds the left side of the envelope (to the left of perforation 133). Second, the recipient pulls to the left or in the downward direction so as to break the perforation 133. By breaking perforation 133, the recipient is also breaking perforations 127 and 131, which are collinear with perforation 133. Subsequently, note that the indented perforation 133 allows the portions of the edges of documents 150 and 151 to protrude from the indented perforation 133. Third, the recipient holds on to the portions of the edges of documents 150 and 151 that protrude from the indented perforation 133. Fourth, the right side of the envelope (to the right of perforation 132) is held by the recipient utilizing his thumb and forefinger. Fifth, the documents 150 and 151 are extracted from the mailer 100 by pulling to the left. As the documents 150 and 151 are extracted, the perforations 125 and 129, which respectively hold the documents 150 and 151 to the mailer 100, are broken so as to free the documents 150 and 151.

Figure 9:
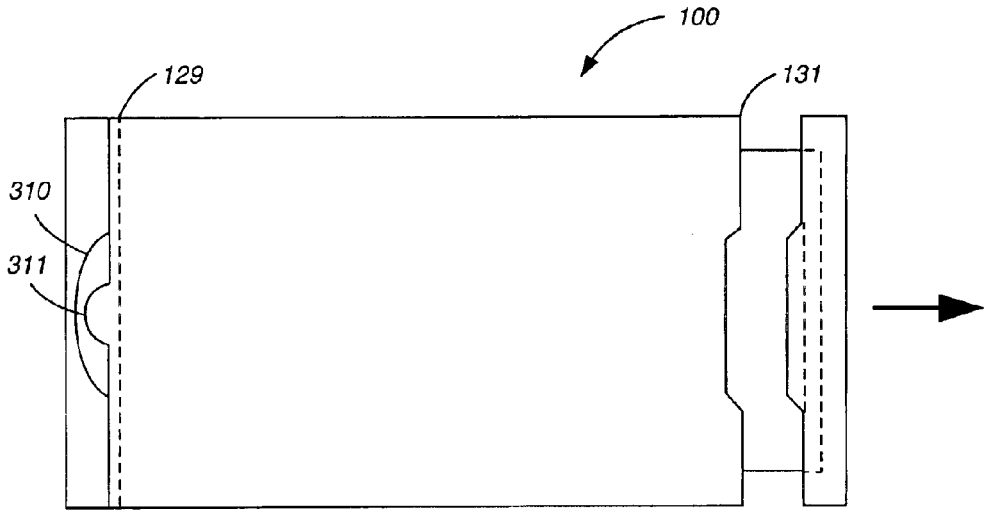
FIG. 9 shows a top view of the back of the mailing form of FIG. 1A as it is being opened by the recipient.

FIG. 9 shows a top view of the back of the mailing form, or mailer 100, of FIG. 1A as it is being opened by the recipient. FIG. 9 shows the documents 150 and 151 being extracted as described with reference to FIG. 8 above. FIG. 9 also shows that the recipient can hold the side of the envelope (to the left of perforation 129), at tab 310 and tab 311.

Figure 10:
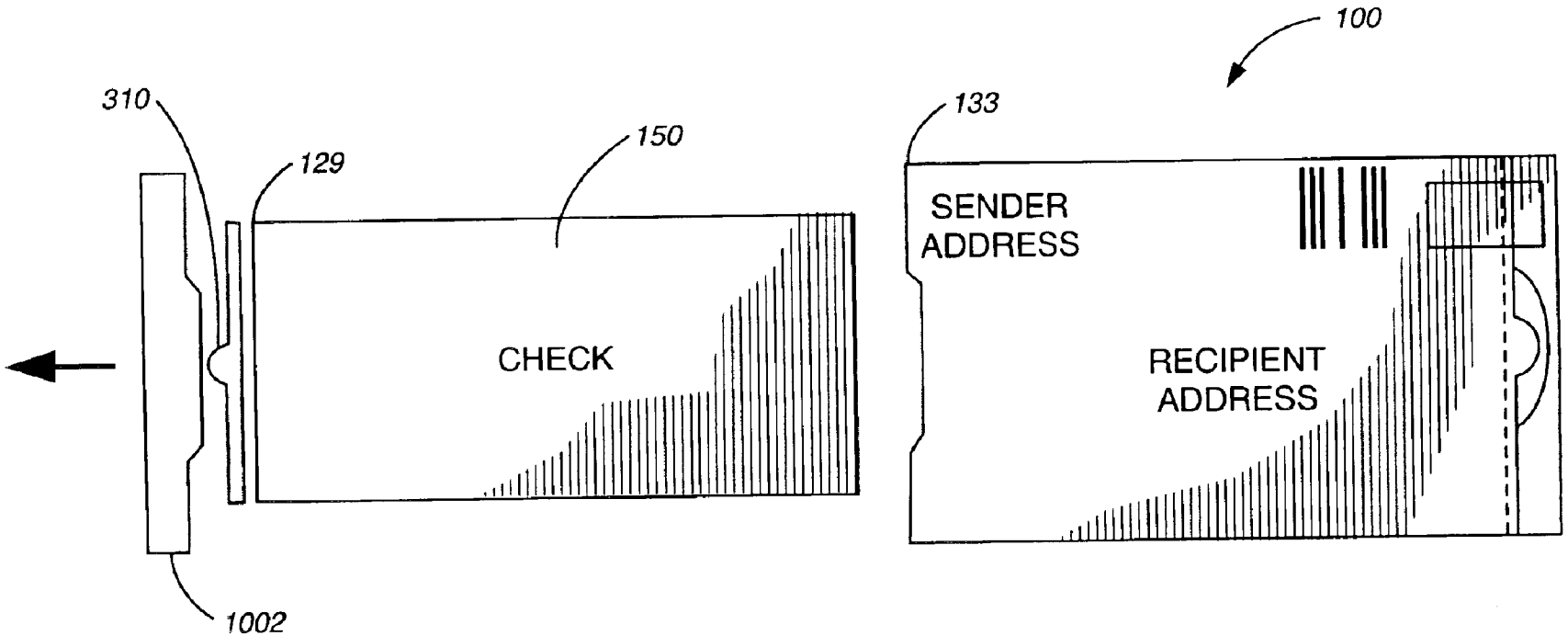
FIG. 10 shows a top view of the front of the mailing form of FIG. 1A as the document is being removed from the mailing form.

FIG. 10 shows a top view of the front of the mailing form, or mailer 100, of FIG. 1A as the documents 150 and 151 are being removed from the mailer 100. FIG. 10 shows that a paper strip 1002 is extracted from the mailer 100 when the recipient breaks the perforation 133 and extracts the documents 150 and 151. By breaking perforation 133, the recipient is also breaking perforations 127 and 131, which are collinear with perforation 133. This exposes a portion of the documents 150 and 151. Also note that perforation 125 can be broken so as to free the document 150 from a strip of paper containing the tab 310. FIG. 10 shows that the document 150 is extracted when the perforation 125 is broken.

Figure 11:
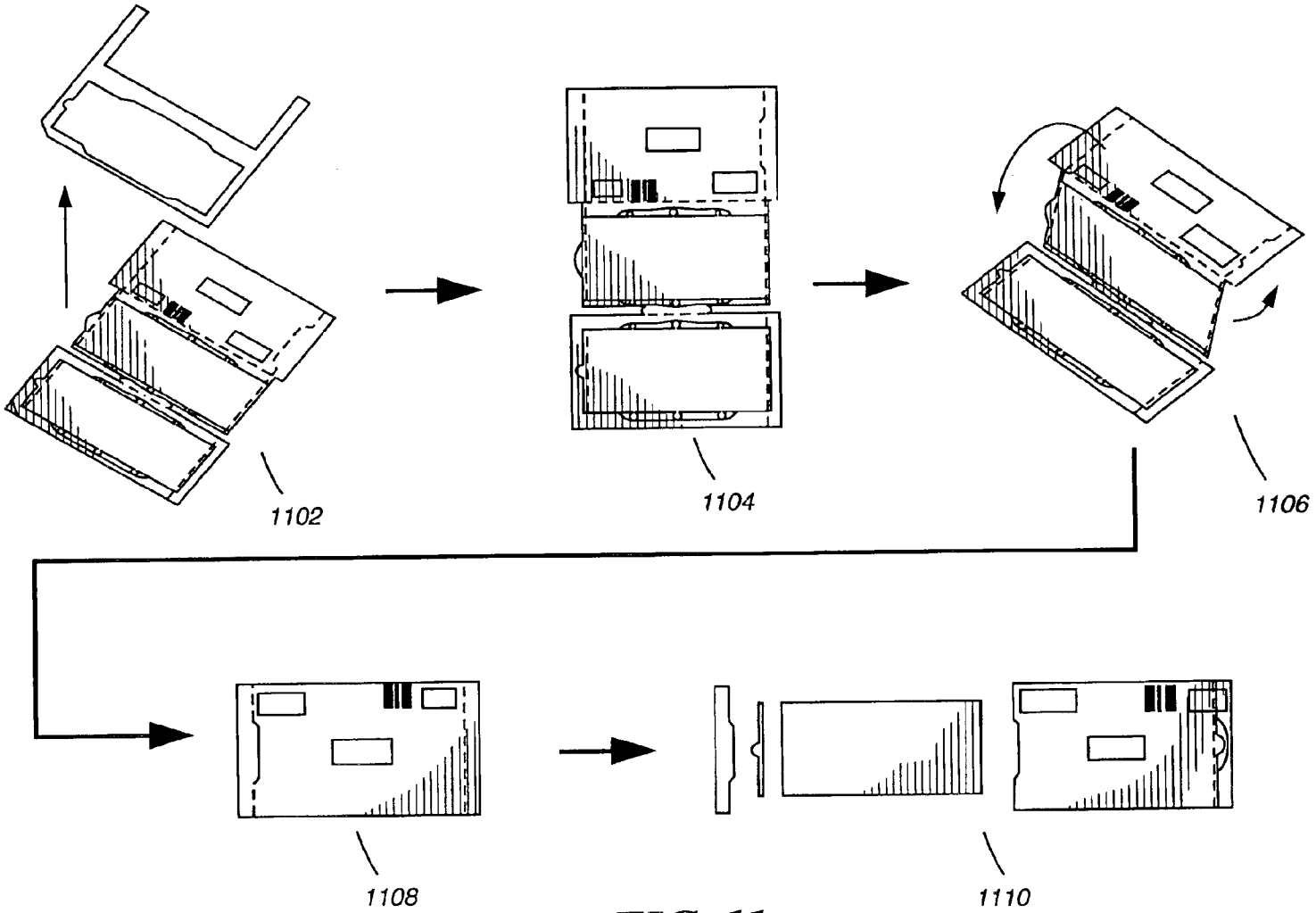
FIG. 11 shows a step-by-step flow of the mailing form of FIG. 1A during its lifecycle.

FIG. 11 shows a step-by-step flow of the mailing form, or mailer 100, of FIG. 1A during its lifecycle. In the first step 1102, the frame portion 200 of the mailer 100 is removed. See FIGS. 1A–2. In the next step 1104, the mailer 100 is prepared for folding into folded form for mailing. See FIGS. 3–4. In the next step 1106, the mailer 100 is folded so as to produce a mailer 100 in folded form for mailing. See FIG. 5. Next, in step 1108, the mailer 1108 is in folded form and prepared for mailing. See FIGS. 6–7. Finally, in step 1110, the documents 150–152 in the mailer 100 are extracted by the recipient. See FIGS. 8–10.

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments. Furthermore, it is intended that the appended claims cover any and all such applications, modifications, and embodiments within the scope of the present invention.

What is claimed is:

1. A mailing form for facilitating the mailing of a document, the mailing form comprising a first panel, a second panel, and a third panel of substantially the same area, each panel separated by a horizontal fold line, comprising:

a top ply of a mailing form;

a document in a second panel of the top ply, wherein at least a portion of a perimeter of the document is die-cut;

a bottom ply coupled to the top ply, such that the top ply lies on top of the bottom ply;

a frame portion of the top ply extending over the second panel and a third panel, wherein an inner diameter of the frame portion is die-cut so as to allow the frame portion to be removed;

an adhesive on outer edges of a front of the bottom ply extending over the second panel and the third panel, wherein the adhesive is exposed when the frame portion is removed;

a first horizontal fold line between the first panel and the second panel such that a back of the first panel is folded so as to meet a back of the second panel; and a second horizontal fold line between the second panel and the third panel, such that when the front of the bottom ply of the third panel is folded so as to meet the front of the bottom ply of the second panel, the outer edges of the front of the second panel and the outer edges of the back of the first panel adhere to the adhesive on the front of the third panel, wherein when the mailing form is in folded form, the document in the second panel is securely situated between the first panel and the third panel.

2. The mailing form of claim 1, further comprising:

a perforation along the inside of a right edge of the bottom ply, the perforation extending through the first, second and third panel, such that the right edge of the bottom ply is removable when the mailing form is in folded form and wherein when the right edge of the bottom ply is removed when the mailing form is in folded form, a right edge of the document is exposed.

3. The mailing form of claim 2, further comprising:

a perforation along a left edge of the document, wherein when the document is pulled in the right direction when the mailing form is in folded form, the perforation breaks and frees the document.

4. The mailing form of claim 1, wherein the frame portion of the top ply extends over the outer edges of the second and third panel and along the bottom edge of the document.

5. The mailing form of claim 4, wherein the backside of the frame portion of the top ply includes a releasable substrate.

6. The mailing form of claim 1, wherein the upper portion and the bottom portion of the document is die cut and wherein the left portion and the right portion of the document is die-cut.

7. The mailing form of claim 6, wherein when the right edge of the bottom ply is removed when the mailing form is in folded form, a right edge of the document is exposed.

8. The mailing form of claim 7, wherein when the document is pulled in the right direction when the mailing form is in folded form, the perforation breaks and frees the document.

9. The mailing form of claim 1, wherein the document is any one of:

a check;

an account statement;

a letter;

a notice; and an invoice.

10. The mailing form of claim 1, wherein the bottom ply is coupled to the top layer along the first horizontal fold line.

11. The mailing form of claim 10, wherein the backside of the frame portion includes a releasable substrate.

12. The mailing form of claim 11, wherein the bottom ply is further coupled to the top ply by means of the adhesive on the outer edges of the front of the bottom ply adhering to the releasable substrate on the backside of the frame portion of the top ply.

13. The mailing form of claim 1, wherein the front of the top ply in the first panel includes variable information.

14. The mailing form of claim 13, wherein the variable information includes a sender address, a recipient address and postage indicia.

15. The mailing form of claim 14, wherein the variable information is printed in an upward-facing orientation.

16. The mailing form of claim 14, wherein the variable information is printed in a downward-facing orientation.

17. The mailing form of claim 1, wherein the mailing form is adapted for printing in a single pass through a sheet-fed, simplex, non-impact printer.

18. The mailing form of claim 1, wherein the document in the top ply of the second panel is not laminated to the bottom ply of the second panel and removable therefrom when the mailing form is in folded form.

19. The mailing form of claim 1, wherein a document in the top ply of the third panel is not laminated to the bottom ply of the third panel and removable therefrom when the mailing form is in folded form.

20. A mailing form comprising:

a first panel, a second panel and a panel of substantially a same rectangular area, the first panel and the second panel separated by a first horizontal fold line and the second panel and the third panel separate by a second horizontal fold line;

wherein at least the first panel and the second panel are constructed from a top ply substantially covering a bottom ply and a portion of the top ply is adhesively bound to the bottom ply to form a top-bottom ply laminate;

wherein at least the portion of the top ply of the first panel is die-cut to form an outer frame which is removable to expose adhesive outer edges of a back surface of the bottom ply with adhesive disposed thereon;

wherein the top-bottom ply laminated of the second panel is die-cut to form a pair of side frames which when removed, reduce a width of the second panel along a direction defined by the first horizontal fold line;

wherein at least the portion of the top ply of the second panel is die-cut to form an outer-top frame which is removable to expose a first portion of the bottom ply with adhesive disposed thereon;

wherein at least a second portion of the bottom ply of the second panel is die-cut and adhesively attached to the top ply so as to form one or more voids therein when the top ply is removed;

wherein the second horizontal fold line, such that when a front of the bottom ply of the third panel is folded so as to meet the front of the bottom ply of the second panel, the adhesive outer edges of the back surface of the first panel adhere to the front of the third panel so as to seal the second panel securely between the first panel and the second panel.

21. The mailing form of claim 20, wherein the outer frame formed from the portion of the top ply of the first panel is rectangular in shape.

22. The mailing form of claim 20, wherein in the second panel the each of the top-bottom ply laminated side frames along with the outer-top frame is U-shaped.

23. The mailing form of claim 21, wherein in the second panel the each of the top-bottom ply laminated side frames along with the outer-top frame is U-shaped.

24. The mailing form of claim 22, wherein in the outer frame which is U-shaped and the outer frame of the top ply of the first panel are joined to be removable as a single group of removable frames.

25. The mailing form of claim 22, wherein is substantially the entire second panel is a laminate of the top ply to the bottom ply.

* * * * *